US011203805B2

(12) United States Patent
Chen et al.

(10) Patent No.: US 11,203,805 B2
(45) Date of Patent: Dec. 21, 2021

(54) ALUMINUM ALLOY COMPOSITION AND METHOD

(71) Applicant: UNIVERSITE DU QUEBEC A CHICOUTIMI, Saguenay (CA)

(72) Inventors: Xiao-Guang Chen, Saguenay (CA); Mohammad Shakiba, Saguenay (CA); Nicholas C. Parson, Kingston (CA)

(73) Assignee: UNIVERSITE DU QUEBEC A CHICOUTIMI, Chicoutimi (CA)

( * ) Notice: Subject to any disclaimer, the term of this patent is extended or adjusted under 35 U.S.C. 154(b) by 232 days.

(21) Appl. No.: 15/300,898

(22) PCT Filed: Mar. 31, 2015

(86) PCT No.: PCT/CA2015/050258
§ 371 (c)(1),
(2) Date: Sep. 30, 2016

(87) PCT Pub. No.: WO2015/149175
PCT Pub. Date: Oct. 8, 2015

(65) Prior Publication Data

US 2017/0022591 A1 Jan. 26, 2017

Related U.S. Application Data

(60) Provisional application No. 61/972,948, filed on Mar. 31, 2014.

(51) Int. Cl.
*C22F 1/04* (2006.01)
*C22C 21/00* (2006.01)

(52) U.S. Cl.
CPC ..... *C22F 1/04* (2013.01); *C22C 21/00* (2013.01)

(58) Field of Classification Search
CPC ..... C22C 21/00; C22F 1/04
See application file for complete search history.

(56) References Cited

U.S. PATENT DOCUMENTS

| | | | | |
|---|---|---|---|---|
| 4,010,046 | A * | 3/1977 | Setzer | B21C 23/002 148/438 |
| 2009/0266530 | A1* | 10/2009 | Parson | C22C 21/16 165/180 |
| 2014/0178709 | A1 | 6/2014 | Seki et al. | |
| 2015/0167137 | A1 | 6/2015 | Okaniwa et al. | |
| 2015/0248973 | A1 | 9/2015 | Suzuki et al. | |

FOREIGN PATENT DOCUMENTS

| | | | |
|---|---|---|---|
| CA | 2854838 | A1 | 5/2013 |
| JP | 2014025119 | A | 2/2014 |
| JP | 2014205886 | A | 10/2014 |
| JP | 2014224323 | A | 12/2014 |
| WO | 2013018162 | A1 | 2/2013 |
| WO | 2013125565 | A1 | 8/2013 |
| WO | 2013150957 | A1 | 10/2013 |

OTHER PUBLICATIONS

Jun. 18, 2015—International Search Report and Written Opinion of PCT/CA2015/050258.

Shakiba, et al.; Hot deformation behavior and rate-controlling mechanism in dilute Al—Fe—Si alloys with minor additions of Mn and Cu; article; Materials Science and Engineering A 636 (2015), Apr. 18, 2015; p. 572-581; journal homepage: www.elsevier.com/locate/msea; (QC), Canada.

* cited by examiner

*Primary Examiner* — Anthony M Liang
(74) *Attorney, Agent, or Firm* — Banner & Witcoff, Ltd.

(57) ABSTRACT

An aluminum alloy composition includes, in weight percent: less than or equal to 0.70 iron; less than or equal to 0.30 silicon; and less than or equal to 0.30 copper, with the balance being aluminum and other elements, with the other elements being present at up to 0.05 weight percent each and up to 0.15 weight percent total. The alloy is homogenized at a temperature of 520° C. to 570° C. for 2-10 hours. The volume phase fraction of a-AlFeSi phase present in the homogenized aluminum alloy product may be at least 10%.

23 Claims, 8 Drawing Sheets

ALUMINUM ALLOY COMPOSITION AND METHOD

CROSS-REFERENCE TO RELATED APPLICATIONS

The present application is a U.S. National Phase filing of International Application No. PCT/CA2015/050258, filed on Mar. 31, 2015, designating the United States of America and claiming priority to U.S. Provisional Application No. 61/972,948 filed Mar. 31, 2014, and the present application claims priority to and the benefit of both the above-identified applications, which are both incorporated by reference herein in their entireties.

TECHNICAL FIELD

The invention relates generally to an aluminum alloy composition and methods of manufacturing and/or homogenizing that can be used with the composition, and more specifically, to a 1XXX series, Al—Fe—Si type aluminum alloy and methods that include homogenization to increase extrudability.

BACKGROUND

Aluminum alloys are often cast to produce ingots or billets that are ultimately rolled or extruded to produce various aluminum alloy products. A homogenization procedure is normally required prior to rolling or extrusion in order to achieve desired properties, such as a more uniform elemental distribution and/or a specific microstructure. One group of commonly used aluminum alloys are 1XXX series or Al—Fe—Si type alloys, which are typically homogenized at high temperatures of 580° C. and higher.

One of the main factors affecting extrusion productivity of Al—Fe—Si based alloys is high temperature flow stress. A given extrusion press with a given tonnage and container diameter has a maximum specific pressure available to push a billet through the die. The pressure required to extrude a billet is a direct function of the alloy flow stress. Aluminum alloys are known to exhibit strain rate sensitivity. The higher the strain rate or ram speed, the higher the flow stress. For a given press capacity and profile geometry, the flow stress of the material will dictate the maximum ram speed at which the press can operate. Extrusion speed is also limited by the profile exit temperature. Typically, as the alloy solidus is approached, the surface finish of the product deteriorates. A material with a lower flow stress can typically be extruded at a lower billet temperature, thereby delaying or avoiding the onset of surface defects. Additionally, alloys with lower flow stress can be extruded at faster rates than alloys with higher flow stress. Thus, when extruding 1XXX alloys or other aluminum alloys, reducing high temperature flow stress can assist in achieving greater extrusion productivity and/or better extrusion quality. Similar benefits can be obtained for alloys used in other processing techniques, such as rolling.

Accordingly, there exists a need for aluminum alloy materials having low high-temperature flow stress and methods of producing such materials.

The present composition and method are provided to address the problems discussed above and other problems, and to provide advantages and aspects not provided by prior compositions and methods of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the present disclosure relate to a method that includes homogenizing an aluminum alloy composition that includes, in weight percent:

up to 0.70 iron;
up to 0.30 silicon; and
up to 0.30 copper with the balance being aluminum and other elements, with other elements being present at up to 0.05 weight percent each and up to 0.15 weight percent total. The homogenization is performed at a homogenization temperature of 520° C. to 570° C. for 2-10 hours. The homogenization may be conducted for 2-10 hours. The homogenized aluminum alloy may be further processed, such as by extrusion to create an extruded product, or rolling to create a rolled product. The alloy may be a 1XXX-series alloy in some aspects.

According to one aspect, the iron content of the alloy is 0.20 to 0.40 wt. %, and the silicon content of the alloy is 0.05 to 0.20 wt. %. In one embodiment, the alloy may have a maximum flow stress after homogenization of 27.5 MPa at a temperature of 450° C., a strain rate of 1/sec, and a strain of 0.8.

According to another aspect, the homogenization temperature is in the range of from 540° C. to 570° C., or may be about 550° C. in one embodiment.

According to a further aspect, the method also includes cooling the homogenized aluminum alloy composition to a temperature of 400° C. or lower at a rate of 450° C. per hour or less.

According to yet another aspect, the alloy after homogenization has a phase fraction α-AlFeSi of no more than a 5% difference after homogenization, compared to the alloy before homogenization. The homogenized alloy may have an α-AlFeSi phase, an $Al_3Fe$ phase, and an $Al_6Fe$ phase, in one embodiment, and the phase fraction of α-AlFeSi phase in the homogenized alloy may be at least 10%.

According to a still further embodiment, the alloy has an electrical conductivity after homogenization that is at least 1.5% IACS higher than the alloy before homogenization.

Additional aspects of the disclosure relate to a method as described herein, which further includes casting the aluminum alloy composition to form a cast aluminum alloy product. The cast aluminum alloy product may be in the form of a billet or other intermediate product. The cast product may then be homogenized as described herein, and optionally further processed, such as by extrusion, rolling, etc.

Further aspects of the disclosure relate to an aluminum alloy as described herein or a homogenized aluminum alloy product formed of such an alloy. The composition of the alloy, as described herein, may include, in weight percent:

up to 0.70 iron;
up to 0.30 silicon; and
up to 0.30 copper with the balance being aluminum and other elements, with other elements being present at up to 0.05 weight percent each and up to 0.15 weight percent total. The alloy may further have an iron content of 0.20 to 0.40 wt. % and/or a silicon content of 0.05 to 0.20 wt. %.

According to one aspect, after homogenization, the alloy product may have any of the properties described herein, including flow stress, conductivity, microstructure, etc. The homogenization may be performed at 520° C. to 570° C. for 2-10 hours in one embodiment.

According to another aspect, a billet or other product formed of an alloy as described above, having an iron content of 0.20 to 0.40 wt. % and a silicon content of 0.05 to 0.20 wt. %, and being homogenized at 520° C. to 570° C., may have a maximum flow stress of 27.5 MPa at a temperature of 450° C., a strain rate of 1/sec, and a strain of 0.8.

Other features and advantages of the disclosure will be apparent from the following description taken in conjunction with the attached drawings.

BRIEF DESCRIPTION OF THE DRAWINGS

Some embodiments are illustrated by way of example, and not by way of limitation, in the figures of the accompanying drawings.

DETAILED DESCRIPTION

Figure 1:
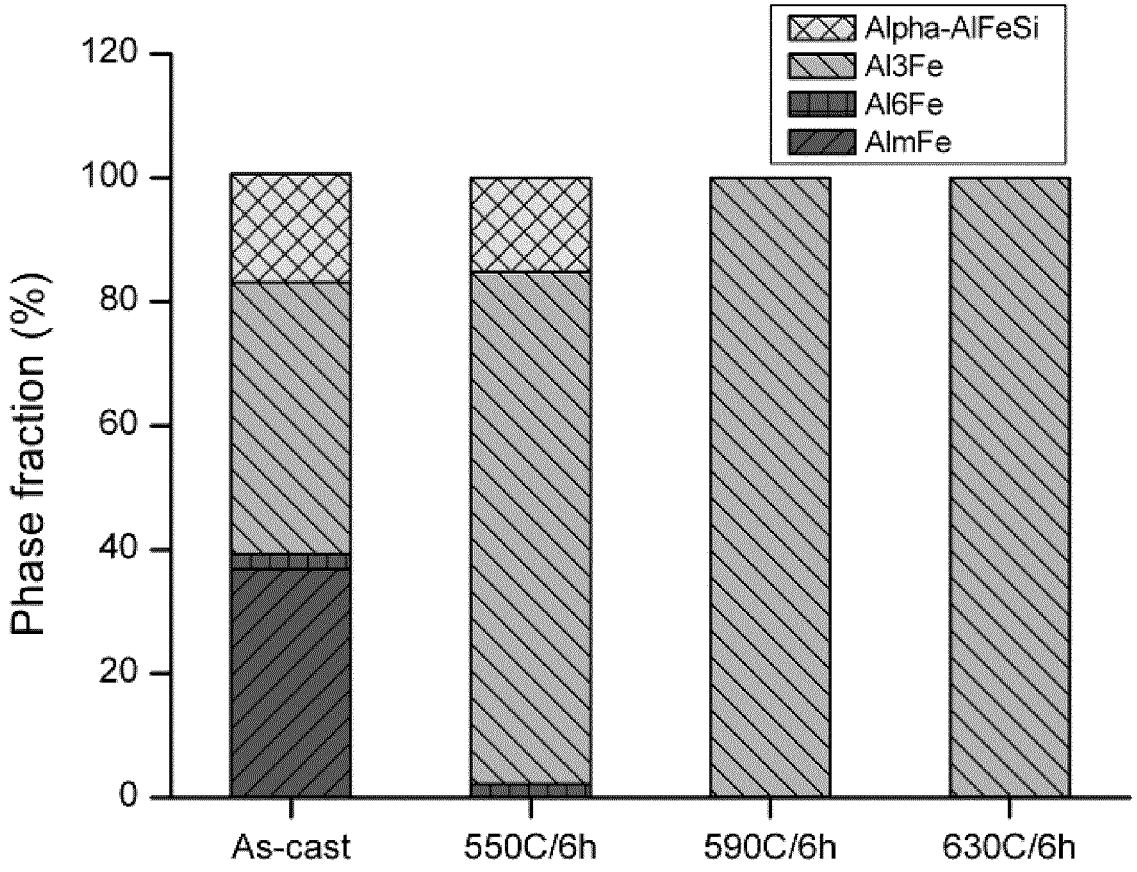
FIG. 1 is a graphical representation of the evolution of the phase volume fractions of Fe-rich intermetallics in the as-cast and homogenized conditions of an aluminum alloy according to certain embodiments.

In general, homogenized aluminum alloy compositions (e.g., 1XXX) having reduced high temperature flow stress are provided. Methods of homogenizing aluminum alloy compositions which result in homogenized aluminum alloy compositions having reduced high temperature flow stress are also provided. Methods of manufacturing products using such Al—Fe—Si based alloys, including homogenizing the alloy prior to extrusion, are also provided. Such manufacturing methods may include extrusion or rolling. Products with improved electrical and thermal conductivity and Al—Fe—Si phase stability are further detailed herein.

In one or more embodiments, an aluminum alloy composition may comprise, consist of, or consist essentially of, in weight percent:

less than or equal to 0.70 iron;

less than or equal to 0.30 silicon; and less than or equal to 0.30 copper, with the balance being aluminum and other elements, individual other elements being present at up to 0.05 weight percent, the total other elements content being up to 0.15 weight percent, and the total combined weight percent of iron and silicon being up to 1.00.

In various embodiments, the iron content of the alloy may be up to 0.70 wt. % or up to 0.40 wt. %. Additionally, the alloy may have a minimum iron content of 0.05 wt. % or 0.20 wt. % in some embodiments, i.e., 0.05-0.70 wt. %, 0.05-0.40 wt. %, 0.20-0.40 wt. %, or 0.20-0.70 wt. %.

In some embodiments, the silicon content of the alloy may be up to 0.30 wt. %, up to 0.25 wt. %, or up to 0.20 wt. %. Additionally, the alloy may have a minimum silicon content of 0.03 wt. % or 0.05 wt. % in some embodiments, i.e., 0.03-0.30 wt. %, 0.03-0.25 wt. %, 0.03-0.20 wt. %, 0.05-0.30 wt. %, 0.05-0.25 wt. %, or 0.05-0.20 wt. %.

In one or more embodiments, the copper content of the alloy may be up to 0.30 wt. % or up to 0.05 wt. %. Copper may be present in the alloy as an intentional addition, controlled impurity or unavoidable impurity in various embodiments. In certain embodiments, the alloy may be free or essentially free of copper, and/or may have no intentional or deliberate addition of copper.

"Other elements" may be present in the alloy as additions, controlled impurities or unavoidable impurities. In some embodiments, other elements may include Mn, Cr, Ni, Zn, Ti, V, or combinations thereof. For example, Ti may be added for grain refining purposes, which may be accomplished through addition of Ti—B master alloy. In certain embodiments, the alloy may be free or essentially free of other elements, and/or may have no intentional or deliberate addition of other elements. In some embodiments, individual other elements may be individually present at up to 0.05 weight percent and the total content of such other elements may be up to 0.15 weight percent.

In various embodiments, the aluminum alloy composition is a 1XXX series, Al—Fe—Si based alloy. Exemplary 1XXX series aluminum alloys include, but are not limited to, Aluminum Association (AA) alloys such as AA1100, AA1235, AA1435, AA1050, AA1060, or AA1350.

In certain embodiments, the aluminum alloy composition may be cast to produce an as-cast aluminum alloy product (i.e., an intermediate product). The term "intermediate product" as used herein may refer to an ingot, billet or other semi-finished product, which may be produced via a variety of techniques, including casting techniques such as continuous or semi-continuous casting and others.

In various embodiments, the aluminum alloy composition (i.e., in the form of an intermediate product) is homogenized at temperatures of 520-570° C. In another embodiment, the homogenization temperature may be 540-570° C. The homogenization soak may be carried out for 2-10 hours in one embodiment, e.g., homogenizing for about 6 hours. Additionally, the alloy may be cooled after homogenization at a rate of 450° C./hr or less, to a temperature of 400° C. or below, in one embodiment. Homogenization may be carried out using various techniques, such as continuous homogenization (i.e., in a continuous homogenization furnace), batch homogenization, or other techniques.

Electrical conductivity of an aluminum alloy can be indicative of the levels of elements in solid solution. Generally, the higher the solid solution levels, the lower the electrical conductivity. As discussed in more detail with respect to the Examples below and FIGS. 3 and 4, the use of a lower homogenization temperature results in a significant increase in conductivity due to precipitation of intermetallics. Conventional homogenization temperatures typically result in lower conductivity due to the dissolution of intermetallics. In certain embodiments, the homogenized aluminum alloy product may have an electrical conductivity that is at least 56.75 percent International Annealed Copper Standard (% IACS) or at least 58.5% IACS. It is understood that the conductivity may be significantly influenced by variations in certain elements (even in trace concentrations) like Ti and V present in the raw aluminum used to prepare the batch. Accordingly, the increased conductivity achieved by the homogenization treatment described herein may also be expressed as an absolute change (Δ, expressed in % IACS) or as a proportional percentage change (i.e., Δ/(as-cast)). In one embodiment, expressed as an absolute change, the alloy after homogenization may experience an increase of at least 0.8% IACS or at least 1.0% IACS over the same alloy after casting and before homogenization. In one embodiment, expressed as a proportional change, the conductivity of the aluminum alloy after homogenization is at least 1.5% higher than the conductivity of the same alloy after casting and before homogenization. In other embodiments, the conductivity of the aluminum alloy after homogenization is at least 1.74% higher, at least 1.9% higher, or at least 2.9% higher than the conductivity of the same alloy after casting and before homogenization.

Homogenization temperatures lower than those commonly used in the industry (i.e., 580° C. or higher) result in reduced solid solution levels of iron and silicon. As discussed in more detail with respect to the Examples below and FIGS. 1 and 2, the use of a lower homogenization temperature allows some silicon to remain tied-up in the α-AlFeSi phase, while conventional higher homogenization temperatures result in more silicon entering solid solution and reduction or elimination of the α-AlFeSi phase. Similarly, higher homogenization temperatures tend to result in elimination of other phases present in the intermediate product, such as $Al_6Fe$ and $Al_mFe$. In various embodiments, the homogenized aluminum alloy may have at least an α-AlFeSi phase, an $Al_3Fe$ phase, and an $Al_6Fe$ phase. It is understood that additional phases may exist in the homogenized alloy as well. In one embodiment, the aluminum alloy, after homogenization, may have a phase fraction of 1 to 5% of the $Al_6Fe$ phase. Additionally, in one embodiment, the aluminum alloy, after homogenization, includes a phase fraction of at least 10% of the α-AlFeSi phase. In other embodiments, the phase fraction of the α-AlFeSi phase in the homogenized aluminum alloy product may be at least 15%, at least 20%, at least 30%, at least 40%, or at least 50%. Additionally, in one embodiment, there is no more than a 5% difference between the phase fraction of α-AlFeSi present in the as-cast aluminum alloy composition and the amount of α-AlFeSi phase present in the same aluminum alloy after homogenization. In other embodiments, this difference may be no more than 3%.

Figure 8:
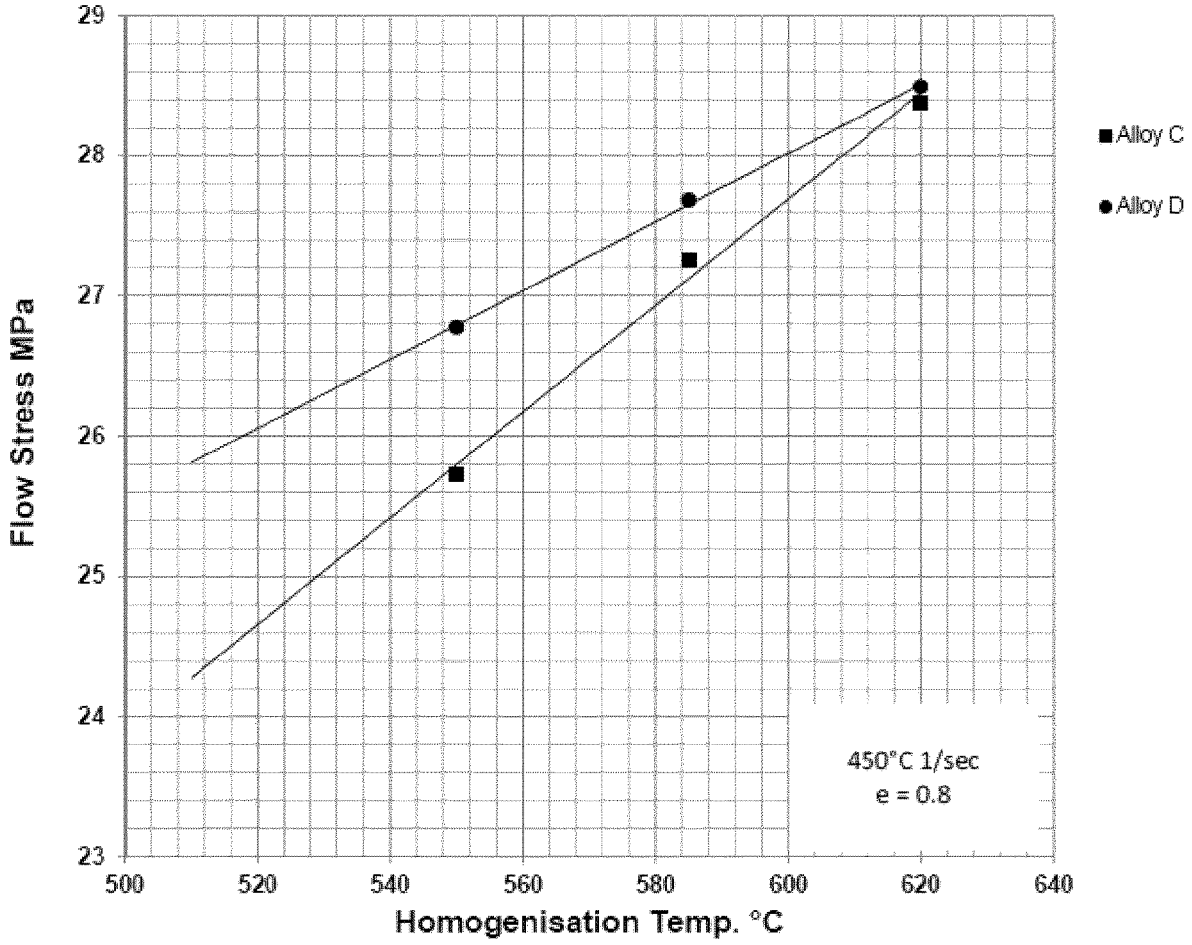
FIG. 8 is a graphical representation of the effect of homogenization on flow stress at a temperature of 450° C. and a strain rate of 1/sec according to certain embodiments.

As discussed in more detail with respect to the Examples below and FIGS. 5, 6 and 8, surprisingly and unexpectedly, the lower temperature homogenization process detailed herein reduces the high temperature flow stress of many common 1XXX series (Al—Fe—Si) alloys, provides improved alloy extrusion speed, and considerably improves extrusion and rolling productivity. For example, in one embodiment, an alloy having a composition as described above, including 0.20-0.40 wt. % Fe and 0.05-0.20 wt. % Si, and homogenization treatment as described above may have a flow stress that is less than or equal to 27.5 MPa, measured at a temperature of 450° C., at a strain rate of 1/sec and a strain of 0.8. In another embodiment, this flow stress may be less than or equal to 26.8 MPa. Moreover, lowering homogenization temperature can reduce energy costs and processing times associated with the manufacture of aluminum alloy products, including the energy and time necessary for homogenization. Without being bound by theory, the use of homogenization temperatures lower than those commonly used in the industry results in reduced solid solution levels of iron and silicon, due to the increased volume fractions of the Al—Fe and AlFeSi phases, which significantly reduces the high temperature flow stress.

The homogenized aluminum alloy composition may be formed into an article of manufacture using a variety of metal processing techniques, such as extrusion, forging, rolling, machining, casting, etc. As described above, the alloy may be provided as an intermediate product (e.g., ingot or billet) for use in such forming processes. For example, an extruded aluminum alloy product (e.g., thin wall tubing) may be produced by extruding the homogenized aluminum alloy to form the extruded aluminum alloy product. A typical extrusion temperature may be 400-500° C., in one embodiment. As another example, a rolled aluminum alloy product may be produced by rolling the homogenized aluminum alloy to form the rolled aluminum alloy product. In some embodiments, the aluminum alloy product may be further processed to alter the shape, size or form of the product. For example, the formed aluminum alloy product may be cut, machined, connected to other components, etc.

Example 1

The alloys in Table 1 were cast into a steel permanent mould of 30×40×80 mm in dimension. They were grain refined by an addition of 0.015 wt. % Ti in the form of Al-5Ti-1B master alloy. The ingots were homogenized at temperatures of 550, 590 and 630° C., for times of 2, 6 and 12 hours. The samples were water quenched after the end of the soak.

TABLE 1

| Alloy Compositions (wt %) | | | | | | | | | |
|---|---|---|---|---|---|---|---|---|---|
| Alloy | Fe | Si | Cu | Mn | Cr | Ni | Zn | Ti | V |
| A | 0.31 | 0.11 | <.01 | <.01 | <.01 | <.01 | <.01 | 0.024 | .01 |
| B | 0.31 | 0.26 | <.01 | <.01 | <.01 | <.01 | <.01 | 0.024 | .01 |

The cast and homogenized microstructures were assessed by optical and scanning electron microscopy. The iron-rich constituent phase types were characterised using the EBSD (electron backscattered diffraction) technique. The backscattered electron diffraction patterns were used to uniquely identify phases based on published crystallographic data using commercially available software. A total of 12 fields with dimensions of 150×150 microns were examined, and all iron-rich intermetallics were identified. The volume fraction of each phase was then measured by image analysis and the phase fraction for each individual phase was calculated by dividing the volume fraction of each individual phase by the total volume fraction of iron-rich intermetallics. The electrical conductivity for each alloy/homogenization condition was measured by an eddy current technique. Flow stress was measured by uniaxial hot compression using a Gleeble 3800 unit, with a sample size of 10 mm in diameter×15 mm tall. Tests were conducted at temperatures of 400 and 500° C. and strain rates of 0.01 and 1/sec. Flow stress values at a strain of 0.8 were used to compare the different treatments.

Figure 2:
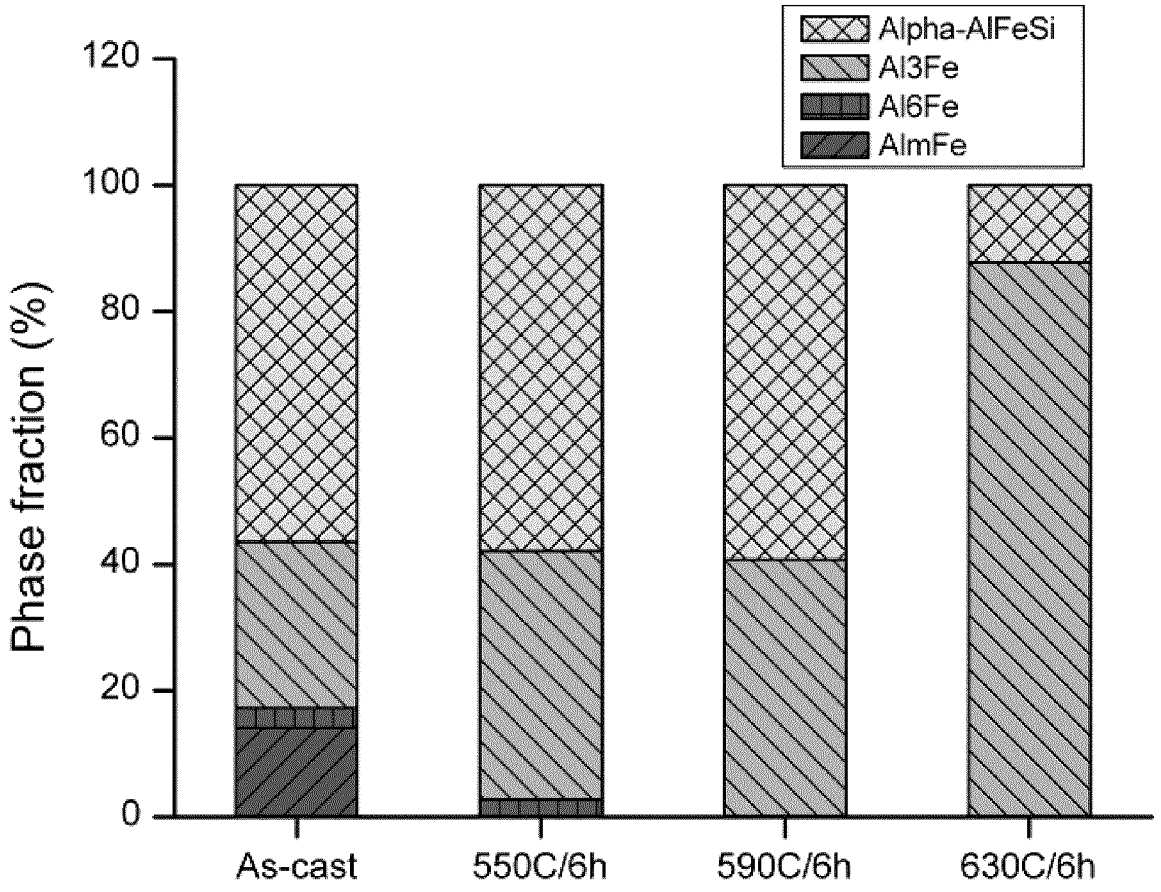
FIG. 2 is a graphical representation of the evolution of the phase volume fractions of Fe-rich intermetallics in the as-cast and homogenized conditions of an aluminum alloy according to certain embodiments.

FIG. 1 illustrates the evolution of the various Al—Fe—Si phase types from the as-cast condition of Alloy A with increasing homogenization temperature. FIG. 2 illustrates the evolution of the various Al—Fe—Si phase types from the as-cast condition of Alloy B with increasing homogenization temperature. In the as-cast condition, both the tested alloys had a mixture of four phase types: α-AlFeSi, $Al_6Fe$, $Al_3Fe$, and $Al_mFe$. Homogenization at 550° C. resulted in transformation of the $Al_mFe$ phase to the equilibrium $Al_3Fe$ in both alloys. However, α-AlFeSi and $Al_6Fe$ remained stable with homogenization at 550° C. in both alloys. Increasing the homogenization temperature to 590° C. resulted in full transformation to $Al_3Fe$ for Alloy A. In the case of Alloy B, the small amount of $Al_6Fe$ transformed to $Al_3Fe$, while the α-AlFeSi remained stable at a homogenization temperature of 590° C. Nearly complete transformation of the α-AlFeSi phase occurred when a temperature of 630° C. was applied to Alloy B; however, a small percentage of the α-AlFeSi phase still remained after a 6-hour soak at 630° C. Therefore, for both alloys, the use of a lower homogenization temperature resulted in the α-AlFeSi phase being stable, such that some silicon remained tied-up in the α-AlFeSi phase, while higher homogenization temperatures resulted in more silicon being able to enter solid solution.

Figure 3:
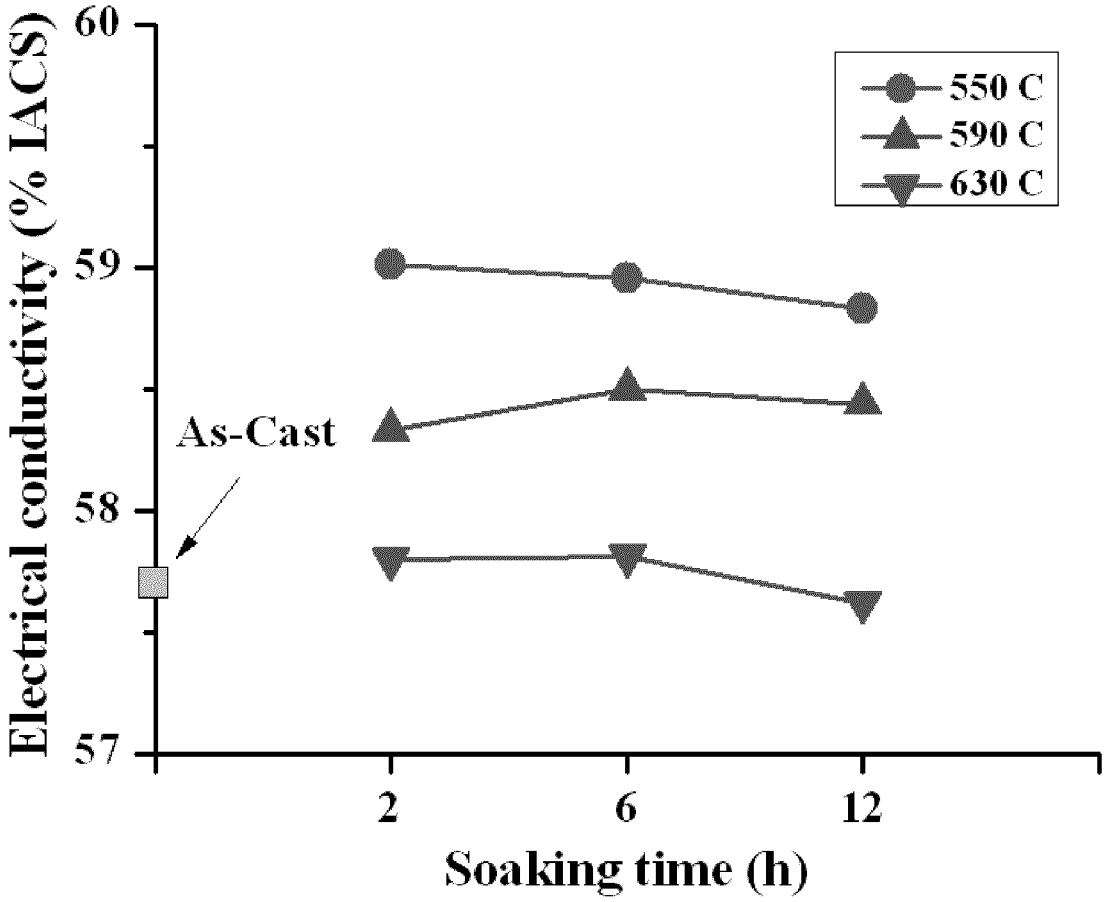
FIG. 3 is a graphical representation of the effect of homogenization on the electrical conductivity of an aluminum alloy according to certain embodiments.
Figure 4:
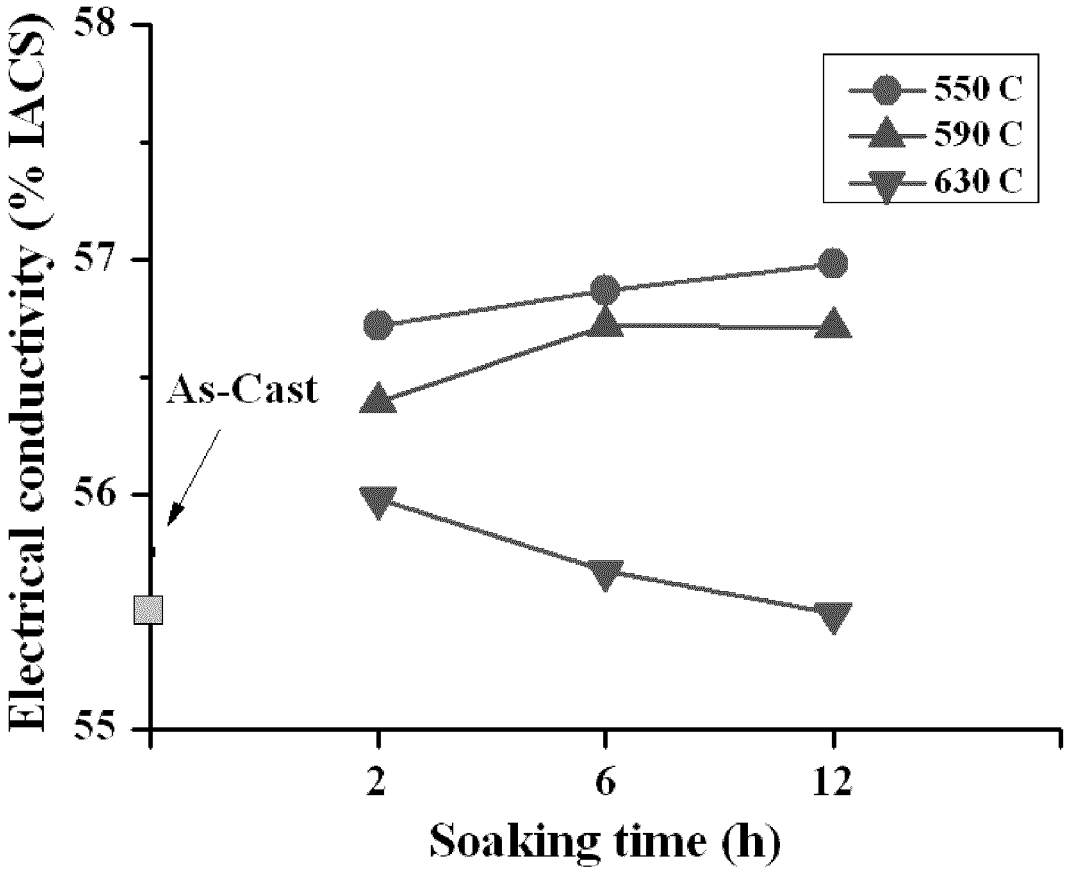
FIG. 4 is a graphical representation of the effect of homogenization on the electrical conductivity of an aluminum alloy according to certain embodiments.

FIGS. 3 and 4 show the conductivity values obtained for Alloys A and B, respectively, homogenized at temperatures of 550, 590 and 630° C., for times of 2, 6 and 12 hours. The conductivity reflects the levels of elements in solid solution, as described above. Additionally, the measured conductivity levels of both alloys for all homogenization conditions are listed in Tables 2 and 3 below, along with the change (A) and the percentage change (% A) from the same alloy as-cast.

With both alloys, homogenizing the as-cast ingot at 550° C. produced a significant increase in conductivity, which was greater than the change for any of the other homogenization temperatures. As reported above, every alloy homogenized at 550° C. experienced a proportional increase in conductivity of at least 1.74% over the same alloy as-cast, and neither of the alloys homogenized at 590° C. or 630° C. experienced a proportional increase in conductivity greater than 1.74%. Such increase in conductivity indicates that the initial high levels of supersaturated Fe and Si in solid solution (i.e., due to high freezing rates during solidification) are reduced by precipitation of intermetallics. Increasing the homogenization temperature to 590° C. and then to 630° C. progressively decreased the conductivity. Such decrease in conductivity indicates dissolution of the intermetallics due to the increase solid solubility at elevated temperature and transformation of α-AlFeSi to $Al_3Fe$. As compared to Alloy A, the conductivity values for Alloy B were always lower due to the corresponding higher levels of silicon in solid solution for a given condition.

Figure 5:
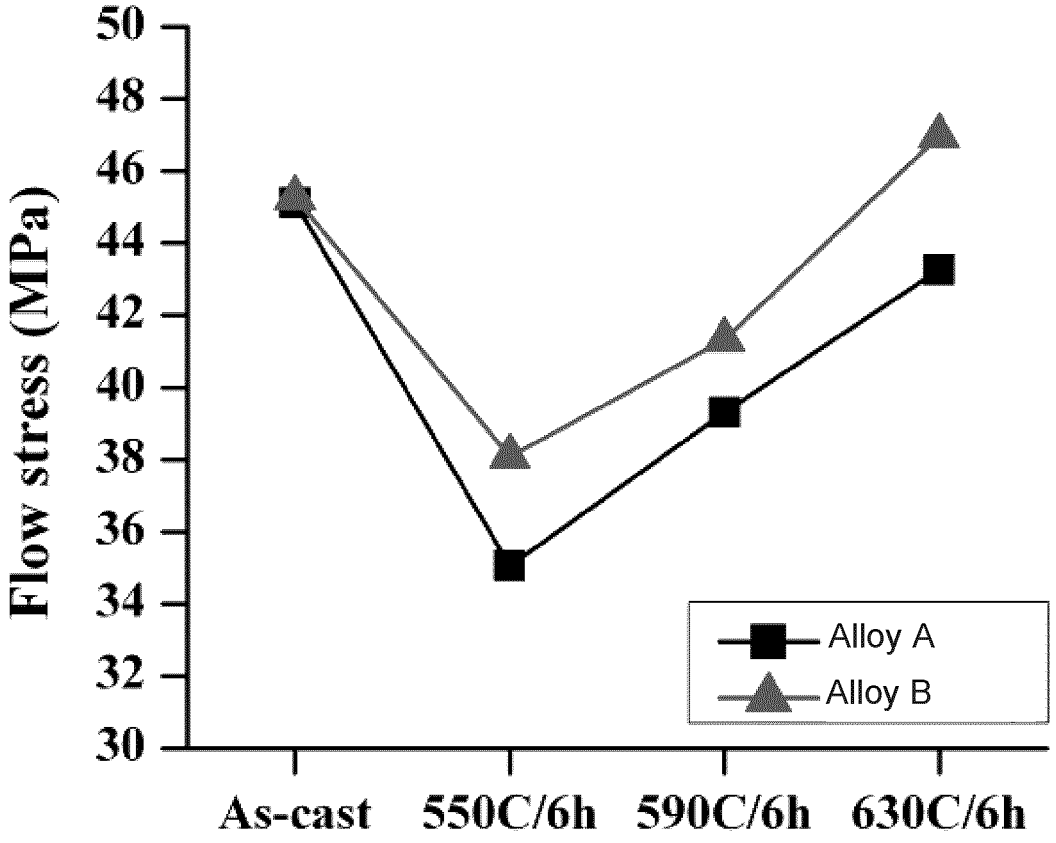
FIG. 5 is a graphical representation of the effect of homogenization on flow stress using a deformation temperature of 400° C. and a strain rate of 1/sec according to certain embodiments.
Figure 6:
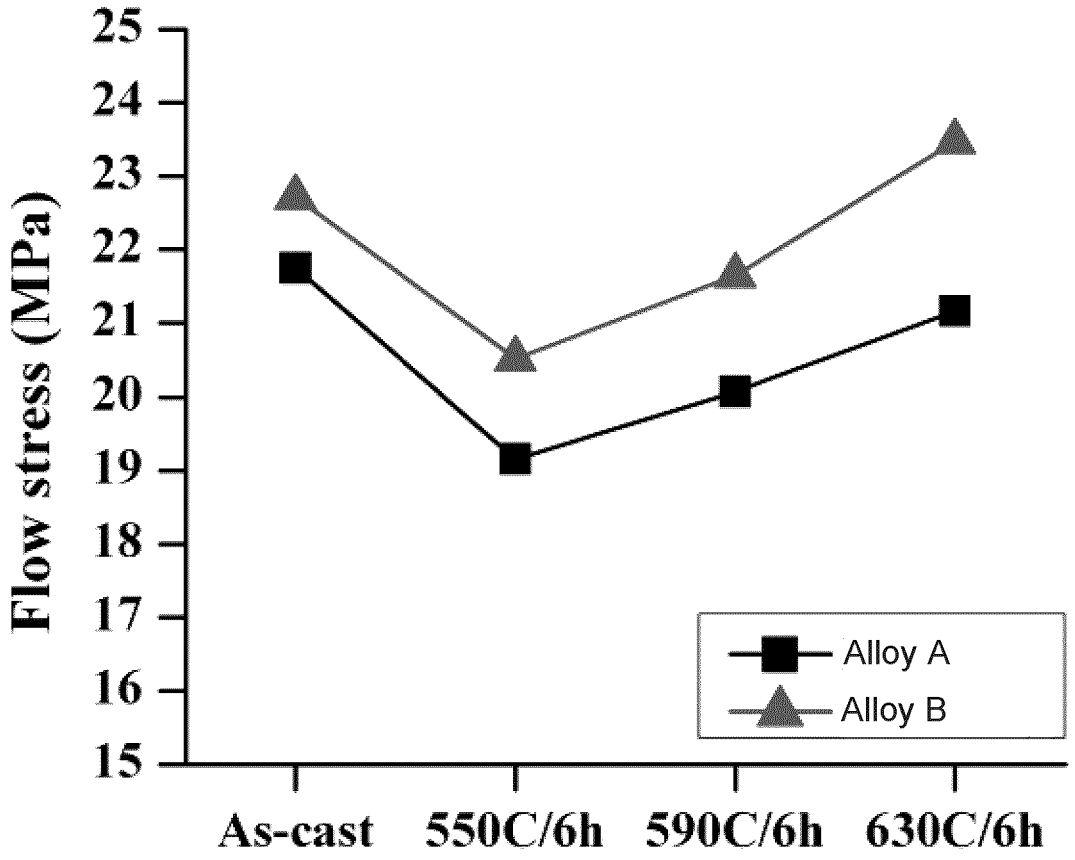
FIG. 6 is a graphical representation of the effect of homogenization on flow stress using a billet temperature of 500° C. and a strain rate of 0.1/sec according to certain embodiments.

The results illustrated in FIGS. 5 and 6 cover the extremes of flow stress and strain rate tested, which reflect a range of potential industrial conditions. FIG. 5 compares the flow stress of Alloys A and B after homogenization for six hours at 550, 590 and 630° C. to the as-cast alloy using a deformation temperature of 400° C. and a strain rate of 1/sec. FIG. 6 compares the flow stress of these alloys after homogenization for six hours at 550, 590 and 630° C. to the as-cast alloy using a billet temperature of 500° C. and a strain rate of 0.1/sec. In both FIGS. 5 and 6, homogenization at 550° C. significantly reduced the as-cast flow stress for both alloys. The flow stress then increased progressively with higher homogenization temperature until it approached the initial as-cast values at 630° C. This was similarly reflected in the conductivities shown in FIGS. 3 and 4, where the conductivity decreased to approach the initial as-cast values after homogenization at 630° C. An increase in the homogenization temperature from 550 to 630° C. increased the flow stress up to 23 and 45% for Alloys A and B, respectively. These trends are consistent with the conduc-

TABLE 2

Conductivity for Alloy A

| Soaking | Electrical conductivity | | | | % Δ vs as cast | | | Δ vs as cast | | |
|---|---|---|---|---|---|---|---|---|---|---|
| time h | % IACS As-cast | % IACS 550° C. | % IACS 590° C. | % IACS 630° C. | % 550° C. | % 590° C. | % 630° C. | % IACS 550° C. | % IACS 590° C. | % IACS 630° C. |
| 0 | 57.73 | — | — | — | | | | | | |
| 2 | — | 59.01 | 58.33 | 57.8 | 2.22 | 1.04 | 0.12 | 1.28 | 0.6 | 0.07 |
| 6 | — | 58.96 | 58.5 | 57.81 | 2.13 | 1.33 | 0.14 | 1.23 | 0.77 | 0.08 |
| 12 | — | 58.83 | 58.44 | 57.62 | 1.91 | 1.23 | −0.19 | 1.1 | 0.71 | −0.11 |

TABLE 3

Conductivity for Alloy B

| Soaking | Electrical conductivity | | | | % Δ vs as cast | | | Δ vs as cast | | |
|---|---|---|---|---|---|---|---|---|---|---|
| time h | % IACS As-cast | % IACS 550° C. | % IACS 590° C. | % IACS 630° C. | % 550° C. | % 590° C. | % 630° C. | % IACS 550° C. | % IACS 590° C. | % IACS 630° C. |
| 0 | 55.75 | — | — | — | | | | | | |
| 2 | — | 56.72 | 56.39 | 55.98 | 1.74 | 1.15 | 0.41 | 0.97 | 0.64 | 0.23 |
| 6 | — | 56.87 | 56.72 | 55.67 | 2.01 | 1.74 | −0.14 | 1.12 | 0.97 | −0.08 |
| 12 | — | 56.98 | 56.71 | 55.49 | 2.21 | 1.72 | −0.47 | 1.23 | 0.96 | −0.26 |

tivity/solid solution results discussed above, and indicate that the flow stress is controlled by the levels of Fe and Si in solid solution due to solid solubility and phase transformation effects.

Table 4 summarizes the results in terms of the flow stress reduction after homogenization relative to the as-cast condition. Over the range of deformation conditions, homogenization at 550° C. reduced the flow stress of Alloy A by 12-22%. In contrast, an 8-13% flow stress reduction resulted from the more conventional 590° C. homogenization treatment. The flow stress reduction for Alloy B was 10-16% for the 550° C. homogenization treatment and 5-9% for the 590° C. homogenization practice. Homogenization at 630° C. resulted in flow stress reductions of 3-4% for Alloy A and an increase in flow stress of 3-4% for Alloy B, relative to the as-cast conditions.

TABLE 4

Flow Stress Results

| | Alloy A | | | | Alloy B | | | |
|---|---|---|---|---|---|---|---|---|
| Treatment | σ 400° C.-1/s | Δ % | σ 500° C.-0.01/s | Δ % | σ 400° C.-1/s | Δ % | σ 500° C.-0.01/s | Δ % |
| As-cast | 45.12 | .. | 21.75 | .. | 45.26 | .. | 22.71 | .. |
| 550° C./6 h | 35.05 | 22.32 | 19.16 | 11.91 | 38.08 | 15.86 | 20.51 | 9.69 |
| 590° C./6 h | 39.31 | 12.88 | 20.07 | 7.72 | 41.32 | 8.71 | 21.65 | 4.67 |
| 630° C./6 h | 43.26 | 4.12 | 21.16 | 2.71 | 46.98 | −3.80 | 23.47 | −3.35 |

Example 2

The alloys in Table 5 were DC cast as 101 mm diameter extrusion billets. They were grain refined with an addition of 0.005 wt. % Ti in the form of Al-5Ti-1B master alloy. Slices of the cast billets were homogenized for 2 hours at temperatures of 510, 530, 550, 585 and 620° C. followed by cooling at 300° C./hr.

TABLE 5

Alloy Compositions (wt %)

| Alloy | Fe | Si | Cu | Mn | Cr | Ni | Zn | Ti | V |
|---|---|---|---|---|---|---|---|---|---|
| C | 0.13 | 0.07 | <.01 | 0.01 | <.01 | <.01 | <.01 | 0.011 | 0.01 |
| D | 0.31 | 0.09 | <.01 | <.01 | <.01 | <.01 | <.01 | 0.015 | 0.01 |

The alloy compositions were measured by Optical Emission Spectroscopy (OES). The electrical conductivity for each alloy/homogenization condition was measured by an eddy current technique. Three samples for flow stress evaluation were machined from the mid-radius position of the ingots homogenized at 550, 585 and 620° C. Flow stress was measured by uniaxial hot compression using a Gleeble 3800 unit, with a sample size of 10 mm in diameter×15 mm tall. Tests were conducted at a temperature of 450° C. and a strain rate of 1/sec. Flow stress values at a strain of 0.8 were used to compare the different treatments.

Figure 7:
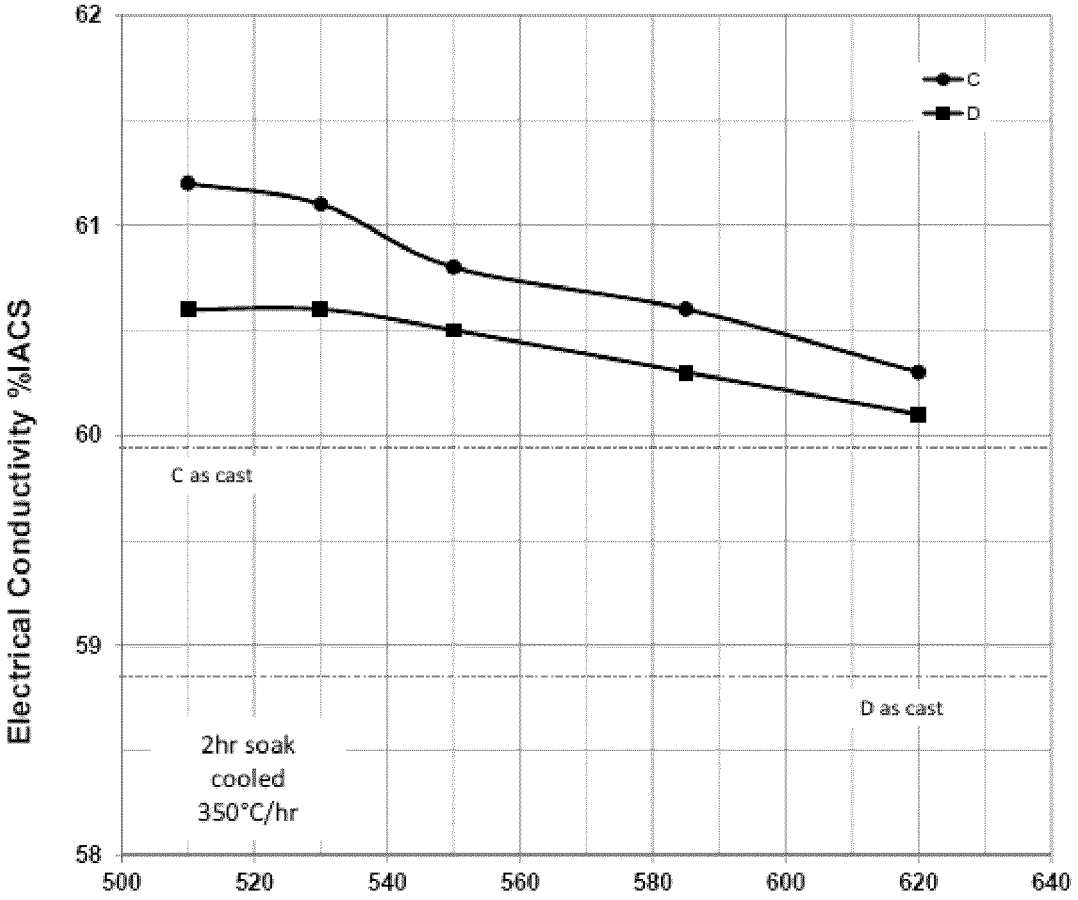
FIG. 7 is a graphical representation of the effect of homogenization on the electrical conductivity of aluminum alloys according to certain embodiments.

FIG. 7 shows the conductivity values obtained for Alloys C and D homogenized at temperatures of 510, 530, 550, 585 and 620° C. for 2 hours. The conductivity reflects the levels of elements in solid solution, as described above. Additionally, the measured conductivity levels of both alloys for all such homogenization temperatures are listed in Table 6 below. Conductivity values for the as-cast alloys are also shown in FIG. 7 and Table 6.

TABLE 6

Electrical Conductivity (% IACS) for Alloys C and D

| Alloy | As-cast | 510° C. | 530° C. | 550° C. | 585° C. | 620° C. |
|---|---|---|---|---|---|---|
| C | 59.9 | 61.2 | 61.1 | 60.8 | 60.6 | 60.3 |
| D | 58.8 | 60.6 | 60.6 | 60.5 | 60.3 | 60.1 |

With both alloys, the as-cast condition had the lowest electrical conductivity, which corresponds to the highest levels of Si and Fe retained in solid solution by the casting process. The application of any of the homogenization treatments increased the conductivity as compared to the as-cast condition, as the elevated temperature allowed the system to move towards equilibrium and precipitate Fe and Si. The lowest conductivity occurred at the highest temperature homogenization at 620° C., and the conductivity consistently increased as the temperature was reduced until, at about 530° C., the effect began to plateau. Without being bound by theory, the increase in conductivity with reduced temperature is thought to be due to increased precipitation of Fe and Si solute at lower temperatures. However, at about 530° C. and below, the lower diffusivity likely reduces the kinetics for the precipitation reaction. Therefore, compared to typical commercial homogenization of 1XXX alloys at 580° C. or above, homogenization of the alloys described herein in the range of 520-570° C. can promote lower Fe and Si solute levels.

Table 7 summarizes the flow stress results of Alloys C and D after homogenization for two hours at 550, 585 and 620° C. using a temperature of 450° C. and a strain rate of 1/sec. These results are also presented graphically in FIG. 8. With both alloys, the flow stress decreased progressively as the homogenization temperature was reduced from the conventional homogenization temperatures above 580° C. down to 550° C., which produced the lowest flow stress. These trends are consistent with the conductivity/solid solution results discussed above, and indicate that the flow stress is significantly influenced by the levels of Fe and Si in solid solution, due to solid solubility and phase transformation effects.

TABLE 7

Flow Stress Results (MPa)

| Alloy | 550° C. | 585° C. | 620° C. |
|---|---|---|---|
| C | 25.72 | 27.25 | 28.38 |
| D | 26.77 | 27.68 | 28.49 |

As shown above and in FIG. 8, reducing the homogenization temperature from 620° C. to 550° C. produced a reduction in flow stress of about 9% for Alloy C and about 6% for Alloy D. These reductions are significant in terms of potential extrusion productivity improvements.

The compositions, products, and methods described herein provide advantages over existing compositions, products, and methods, as evidenced by the Examples above. For example, alloys according to the compositions described herein can exhibit decreased flow stress. Homogenization of the alloy at the temperatures described herein also contributes to achieving this result. This reduction in flow stress makes these alloys effective in extrusion applications, and the alloys can achieve improvements in extrusion rates and productivity. Advantages may also be obtained in other forming techniques, such as rolling. Additionally, the alloy may provide increased thermal and electrical conductivity relative to existing alloys, which could provide advantages for use in electrical wires, conductors, and connectors or components used in heat transfer applications such as tubes or heat sinks. Further benefits and advantages are recognizable to those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims. All compositions herein are expressed in weight percent, unless otherwise noted. It is understood that any of the ranges (e.g., compositions) described herein may vary outside the exact ranges described herein, such as by up to 5% of the nominal range endpoint, without departing from the present invention. In certain embodiments, the term "about" may be used to indicate such variation.

Where products are described herein as having, including, or comprising specific components, or where processes are described herein as having, including, or comprising specific process steps, it is contemplated that the products of the various embodiments can also consist essentially of, or consist of, the recited components, and that the processes of the various embodiments also consist essentially of, or consist of, the recited process steps.

What is claimed is:

1. A method comprising:

homogenizing an aluminum alloy at a homogenization temperature in a range from 520° C. to 570° C. for 2-10 hours, wherein the aluminum alloy has a composition consisting essentially of:

up to 0.70 wt. % iron;

up to 0.30 wt. % silicon; and up to 0.05 wt. % copper, with a balance of aluminum and other elements, wherein the other elements are present at up to 0.05 wt. % each and up to 0.15 wt. % total, wherein the aluminum alloy after homogenization has an α-AlFeSi phase, an $Al_3Fe$ phase, and an $Al_6Fe$ phase; and extruding the aluminum alloy after homogenization to form an extruded aluminum alloy product.

2. The method as claimed in claim 1, wherein the aluminum alloy has a composition consisting essentially of:

0.20 to 0.40 wt. % iron;

0.05 to 0.20 wt. % silicon; and up to 0.05 wt. % copper, with a balance of aluminum and other elements, wherein the other elements are present at up to 0.05 wt. % each and up to 0.15 wt. % total.

3. The method as claimed in claim 2, wherein the aluminum alloy has a maximum flow stress after homogenization of 27.5 MPa at a temperature of 450° C., a strain rate of 1/sec, and a strain of 0.8.

4. The method as claimed in claim 1, wherein the homogenization temperature is in a range of from 540° C. to 570° C.

5. The method as claimed in claim 1, further comprising cooling the aluminum alloy after homogenization to a temperature of 400° C. or lower at a rate of 450° C. per hour or less.

6. The method as claimed in claim 1, wherein a difference between a phase volume fraction of α-AlFeSi of the aluminum alloy after homogenization and a phase volume fraction of α-AlFeSi of the aluminum alloy before homogenization is no more than 5% by volume.

7. The method as claimed in claim 1, wherein the aluminum alloy has an electrical conductivity after homogenization that is at least 1.5% IACS higher than that of the aluminum alloy before homogenization.

8. The method as claimed in claim 1, wherein the aluminum alloy is a 1XXX-series aluminum alloy.

9. The method as claimed in claim 1, further comprising:

casting the aluminum alloy prior to homogenizing, thereby forming a cast aluminum alloy product, wherein the homogenizing is performed on the cast aluminum alloy product;

cooling the cast aluminum alloy product after homogenization to 400° C. at a rate of 450° C. per hour or less, thereby forming a cooled homogenized aluminum alloy product, wherein the cooled homogenized aluminum alloy product is extruded to form the extruded aluminum alloy product.

10. The method as claimed in claim 1, wherein the other elements include titanium and, optionally, boron added for grain refining.

11. The method as claimed in claim 1, wherein the aluminum alloy has an electrical conductivity after homogenization that is at least 1.74% IACS higher than that of the aluminum alloy before homogenization.

12. The method as claimed in claim 1, wherein the aluminum alloy has a composition consisting essentially of:

0.20 to 0.40 wt. % iron;

0.05 to 0.20 wt. % silicon; and up to 0.05 wt. % copper, with a balance of aluminum and other elements, wherein the other elements are present at up to 0.05 wt. % each and up to 0.15 wt. % total, wherein the aluminum alloy has an electrical conductivity after homogenization that is at least 1.74% IACS higher than that of the aluminum alloy before homogenization, and wherein the aluminum alloy has a maximum flow stress after homogenization of 27.5 MPa at a temperature of 450° C., a strain rate of 1/sec, and a strain of 0.8.

13. An extruded product formed of a homogenized aluminum alloy having a composition consisting essentially of:

up to 0.70 wt. % iron;

0.05 to 0.30 wt. % silicon; and up to 0.05 wt. % copper, with a balance of aluminum and other elements, wherein the other elements are present at up to 0.05 wt. % each and up to 0.15 wt. % total, wherein the extruded product has been homogenized at a homogenization temperature in a range from 520° C. to 570° C. for 2-10 hours and extruded after homogenization, and wherein the homogenized aluminum alloy has an α-AlFeSi phase, an $Al_3Fe$ phase, and an $Al_6Fe$ phase.

14. The extruded product as claimed in claim 13, wherein the silicon content is 0.05 to 0.20 wt. % or the iron content is 0.20 to 0.40 wt. %.

15. The extruded product as claimed in claim 13, wherein the homogenized aluminum alloy has a phase volume fraction of α-AlFeSi phase of at least 10%.

16. The extruded product as claimed in claim 13, wherein the homogenized aluminum alloy includes a deliberate addition of copper.

17. The extruded product as claimed in claim 13, wherein the homogenized aluminum alloy is a 1XXX-series aluminum alloy.

18. The extruded product as claimed in claim 13, wherein the homogenization temperature is in a range of from 540° C. to 570° C.

19. The extruded product as claimed in claim 13, wherein the other elements include titanium and, optionally, boron added for grain refining.

20. A method comprising:

homogenizing an aluminum alloy at a homogenization temperature in a range from 520° C. to 570° C. for 2-10 hours, wherein the aluminum alloy has a composition consisting essentially of:

up to 0.70 wt. % iron;

up to 0.30 wt. % silicon; and up to 0.05 wt. % copper, with a balance of aluminum and other elements, wherein the other elements are present at up to 0.05 wt. % each and up to 0.15 wt. % total; and extruding the aluminum alloy after homogenization to form an extruded aluminum alloy product.

21. The method as claimed in claim 20, wherein the aluminum alloy has an electrical conductivity after homogenization that is at least 1.5% IACS higher than that of the aluminum alloy before homogenization, and wherein the aluminum alloy has a maximum flow stress after homogenization of 27.5 MPa at a temperature of 450° C., a strain rate of 1/sec, and a strain of 0.8.

22. A method comprising:

homogenizing an aluminum alloy at a homogenization temperature in a range from 520° C. to 560° C. for 2-10 hours and cooling the aluminum alloy after homogenization to a temperature of 400° C. or lower at a rate of 450° C. per hour or less, wherein the aluminum alloy has a composition consisting essentially of:

up to 0.70 wt. % iron;

up to 0.30 wt. % silicon; and up to 0.30 wt. % copper, with a balance of aluminum and other elements, wherein the other elements are present at up to 0.05 wt. % each and up to 0.15 wt. % total; and extruding the aluminum alloy after homogenization to form an extruded aluminum alloy product, wherein the aluminum alloy after homogenization has an α-AlFeSi phase, an $Al_3Fe$ phase, and an $Al_6Fe$ phase.

23. The method as claimed in claim 22, wherein the aluminum alloy includes a deliberate addition of copper.

* * * * *